United States Patent [19]

Benson et al.

[11] 4,133,332

[45] Jan. 9, 1979

[54] VALVE CONTROL MECHANISM

[75] Inventors: Carl F. Benson, Torrington; Harold W. Humphrey, Jr., Harwinton, both of Conn.

[73] Assignee: The Torrington Company, Torrington, Conn.

[21] Appl. No.: 841,682

[22] Filed: Oct. 13, 1977

[51] Int. Cl.[2] ..... F02D 13/06

[52] U.S. Cl. ..... 123/198 F; 123/90.16; 123/90.57

[58] Field of Search ..... 123/198 F, 90.12, 90.15, 123/90.16, 90.55, 90.57

[56] References Cited

U.S. PATENT DOCUMENTS

| | | | |
|---|---|---|---|
| 1,977,778 | 10/1934 | Rice | 123/198 F |
| 1,985,447 | 12/1934 | Grubbs | 123/198 F |
| 2,019,252 | 10/1935 | Cottingham | 123/90.16 |
| 2,098,115 | 11/1937 | Voorhies | 123/198 F |
| 2,394,738 | 2/1946 | Anthony | 123/198 F |
| 2,503,930 | 4/1950 | Winkler et al. | 123/90.16 |
| 2,948,274 | 8/1960 | Wood | 123/198 F |
| 3,490,423 | 1/1970 | Shunta et al. | 123/90.16 |
| 3,964,455 | 6/1976 | Brown | 123/90.16 |
| 4,050,435 | 9/1977 | Fuller et al. | 123/198 F |

*Primary Examiner*—Ira S. Lazarus
*Attorney, Agent, or Firm*—Frank S. Troidl

[57] ABSTRACT

A tappet or valve lifter is used in an internal combustion engine. The operation of the tappet is hydraulically controlled to selectively stop or start the operation of the engine combustion chamber poppet valve. Tappets may be included in both the intake system and the exhaust system of each cylinder.

2 Claims, 3 Drawing Figures

VALVE CONTROL MECHANISM

This invention relates to internal combustion engines. More particularly, this invention is a new engine combustion chamber poppet valve control mechanism for an internal combustion engine for selectively stopping or starting the operation of one or more poppet valves.

This device is used on an internal combustion engine to operate intake and/or exhaust poppet valves in such a manner that the valves may operate normally or may be deactivated to be inoperative and remain closed. This allows a multi-cylinder engine to run with all cylinders operative when great power outputs are needed such as during acceleration or during a pull up a hill, and to run with one or more of the cylinders inoperative when lesser power outputs are needed such as (1) when idling at a stop or low speed, (2) when cruising steadily at open highway speeds, or (3) when reducing speed. This reduces fuel consumption, reduces noise, reduces exhaust emissions, and reduces friction and wear in the engine.

Mechanisms have been developed to permit the selective deactivating of engine valves, based on changing the location of the fulcrum or pivot bearing of the rocker arm. An example is the mechanism shown in U.S. Pat. No. 3,964,455, issued June 22, 1976. Those mechanisms vary in the method of accomplishing the deactivating action but all result in allowing or forcing the central fulcrum for the rocker arm to change location and in allowing the rocker arm to pivot about the end of the valve stem. The rocker arm is still in a reciprocating mode, continuously oscillating about and in sliding contact with the pivot bearing while deactivated. A complicated and bulky device must be added in the fulcrum area on each valve mechanism to be deactivated.

Our new valve deactivator is a replacement for the conventional, self-adjusting hydraulic valve lifter. It is not intended to be added to existing engines, but rather as a device to be incorporated in an original engine because some modification to the engine block might be necessary in order to properly apply the system.

The advantages of our system for deactivating the engine valves, as compared to the other known systems, are many: (1) It does away with the necessity of adding complicated, bulky, and awkwardly shaped devices on top of the engine heads as required by those other systems; (2) It eliminates the greatly oversized valve covers which must be used with those systems, thus helping alleviate problems of automotive "packagers" who must fit everything into minimum and apparently impossibly small spaces as decreed by the body designers; (3) It eliminates all motion in valve train components above the camshaft when the valve is in the deactivated mode, as compared to the continuous operation and movement of several elements or components hundreds of times per minute in the other known systems when in the valve-deactivated mode. In our system, there is no hydraulic tappet reciprocation, there is no push rod reciprocation, there is no rocker arm oscillation or motion, there is no spring flexing. We have decreased the friction and wear and possible metal fatigue in the components of the valve train mechanism, even including decreased wear of the camshaft, and have reduced maintenance and repair costs statistically simply by decreasing the number of active working components, any one of which is subject to failure; (4) It increases the utilization of the engine fuel for turning the car wheels for more car miles per gallon of fuel by not putting so much power wastefully into overcoming friction of moving components, or flexing of springs, or overcoming inertia of reciprocating parts; (5) Our system is also less expensive than the other known systems, in that our deactivator, instead of being an addition to all other engine components, is actually replacing the present conventional and costly hydraulic valve lifter while using the same engine space formerly used by the hydraulic valve lifter and preferably the same pressured oil source and oil pump formerly used by that valve lifter.

Briefly described, our invention comprises an internal combustion engine having the usual cylinder head reciprocally journalled poppet valves and means for operating the poppet valves. The system also includes a collapsible hydraulic tappet and a hydraulic fluid flow control valve. The control valve controls the flow of oil from the source to the tappet in order to extend the tappet to its activated or operating mode. During the activated mode the tappet is held in contact with the cam of the internal combustion engine so as to follow the cam during its rise and fall. The tappet activates a push rod, the push rod serving as part of the means for operating the poppet valve. The control valve also provides means for flowing the oil from the tappet, causing the tappet to collapse to a position whereby the poppet valve, means for operating the poppet valve, and the tappet are deactivated.

The invention as well as its many advantages may be further understood by reference to the following detailed description and drawings in which.

In the various Figures like parts are referred to by like numbers.

The invention will be described with reference to an 8-cylinder internal combustion engine, although it will be apparent that the invention can be applied to engines having any number of cylinders in excess of one.

Figure 1:
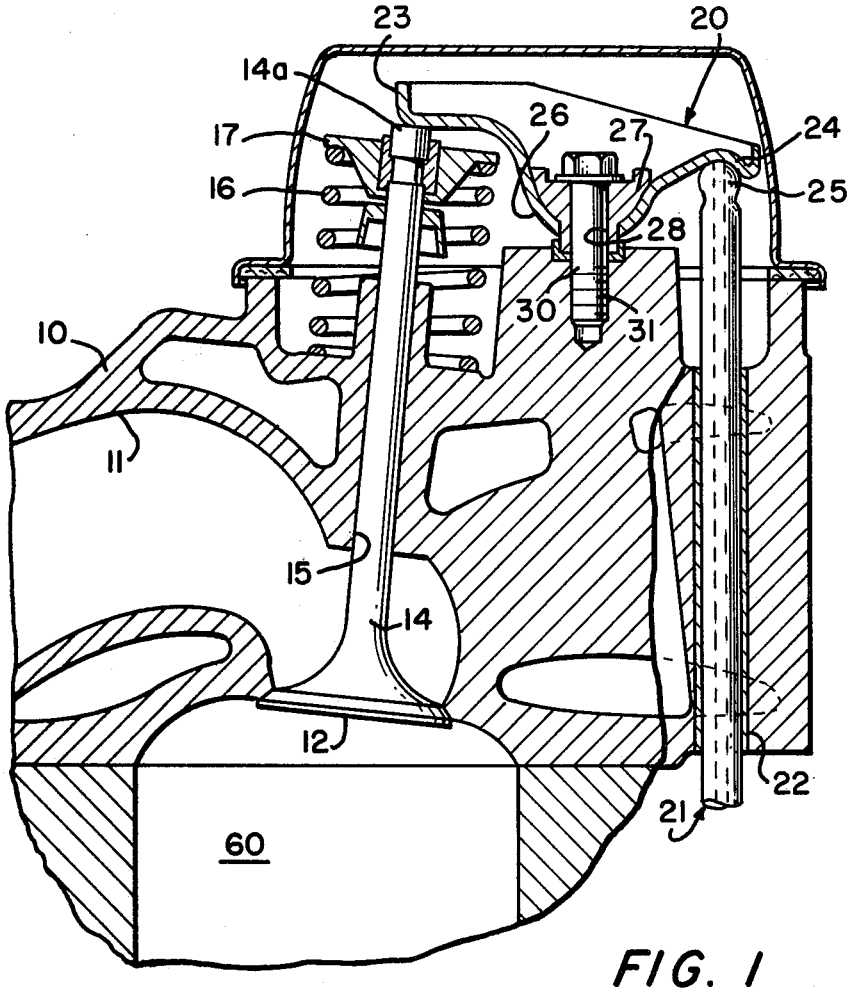
FIG. 1 is a sectional view showing a portion of an internal combustion engine.

Referring now to the drawings and, in particular, to FIG. 1, there is shown an engine of the conventional overhead valve type and includes a cylinder head 10, having a passage therein in communication with a cylinder or combustion chamber 60, the passage 11 being either an induction passage to or an exhaust passage from the cylinder.

Flow between the passage 11 and the cylinder is controlled by a poppet valve 12, the valve stem 14 of which is slidably guided for axial reciprocation in the guide bore 15 provided for this purpose in the cylinder head, with the upper end **14*a* of the valve stem projecting above the cylinder head. In a conventional manner, the valve 12 is normally maintained in a closed position by a spring 16 encircling the upper portion of the stem 14**, with one end of the spring engaging the cylinder head and the other end engaging a conventional retaining washer 17 suitably secured to the stem of the poppet valve.

Opening of the valve 12 is effected by a rocker arm, generally designated 20, that is actuated by a reciprocating push rod 21, passing through the push rod clearance bore 22 in the cylinder head 10, the push rod being disposed laterally of the valve stem with its upper end projecting above the cylinder head.

The push rod 21 and valve 12 are operatively connected by the rocker arm 20 that is formed with arms 23 and 24 overlying and resting against the upper ends 14*a* and 25 of the valve stem and push rod, respectively. Adjacent the outer end of its arm 24, the bottom surface of the rocker arm is spherically dished to receive the upper end 25 of push rod 21 in bearing relation. Intermediate the push rod and valve, the rocker arm 20 is provided with a dished bearing portion 26 which may preferably be either spherically or cylindrically dished, the upper surface of which receives a pivot bearing 27 having a complementarily shaped bottom surface forming a bearing seat for the rocker arm. Centrally of the bearing portion 26, the rocker arm is provided with an aperture 28 through which extends a mounting stud 30 having its lower end fixedly anchored, as by threaded engagement, in the threaded aperture 31 in the cylinder head. Stud 30 normally serves to axially retain the pivot bearing 27.

The rocker arm is fulcrumed on the pivot bearing 27 intermediate its ends so that upon actuation of the push rod 21, the rocker arm pivots about the bearing 27 with its arm 23 then pushing the stem of the poppet valve to effect opening of the poppet valve.

Our engine poppet valve control mechanism includes a tappet 33 (see FIG. 2) and a valving control 34. The hollow push rod 21, rocker arm 20, rocker arm pivot bearing or fulcrum 27, held down by rocker arm stud 30, all work together to impart motion from a cam 35 or other power source to the poppet valve 12. The tappet 33 is positioned in the poppet valve train mechanism so that its state of either collapse or internal fill with hydraulic fluid will cause the poppet valve to respectively not operate (remain still and closed), or to operate normally (opening and closing). We would normally equip both the intake and the exhaust valve operating mechanism of any cylinder with its own collapsible tappet.

The tappet 33 consists of an outer member or cylinder 36, an inner member or piston 37, a seat 38 for the push rod 21, a seat retainer 39, a lubricant flow controller or restrictor 40, a spring 41, annular spring retainer 42 on cylindrical member 36, seat lock balls 43, and a ball retainer 44.

The poppet valve operating mechanism consisting of push rod 21 and rocker arm 20 is lubricated with oil fed from a supply gallery or some other source (not shown) through porting 45, annular chamber 46, porting 47, annular chamber 48, porting 49, and into chamber 50. The oil flows through port 51 in restrictor 40, through port 52 in seat 38, and through the push rod 21, and then lubricates the sliding surfaces on elements 21, 20, 27, and 14. These ports and annular chambers are so placed as to insure a continuous supply of lubricating oil to the rubbing surfaces of the tappet, the push rod, and the rocker arm.

The activation of the engine valve mechanism is accomplished by loading and trapping oil hydraulically in chamber 53, extending the overall length of the tappet. Deactivation is accomplished by unloading or releasing the oil, collapsing or contracting the tappet to a shorter overall length.

When it is desired to activate an engine poppet valve mechanism so that the engine poppet valve will open and close, chamber 53 is expanded by valving in oil under pressure from the regular lubrication system through check valve 54, flow control valve 56 and ports 57 and 58. Alternatively, another source and/or another pump might be used, but at added expense. This oil is prevented from escaping by check valve 54. This pressurized oil extends tappet 33 to its operational length whereby it is in contact with the cam during the dwell of the cam at its lowest point, against the bias of spring 41. The operational extended length of the tappet is then maintained by the pressurized oil trapped in chamber 53 of the tappet by check valve 54. Lifting motion is imparted to the tappet 33 and the push rod 21 by rotation of cam 35 and is transmitted to poppet valve 12, opening the valve. As the cam 35 continues rotating past its high point 55 and drops down, the poppet valve spring 16 closes the poppet valve 12 and pushes the tappet 33 back down by reversal of motion transmitting force through the valve train mechanism, causing the tappet to follow the cam.

Conversely, when chamber 53 is allowed to discharge oil, again through proper hydraulic valving, through ports 58 and 57 and flow control valve 56 back to the oil storage, the lift of cam 35 moves cylinder 36 to the retracted position, expelling the trapped oil. Spring 41 is of sufficient strength to overcome the weight of tappet 33 and push rod 21 in order to keep tappet 33 out of operative contact with cam 35. Tappet 33, together with elements 21, 20, 27 and 12, remain motionless. Poppet valve 12 is deactivated, and no fuel is used.

Valving control such as valving control 34 may be used to feed oil to chamber 53 and trap it there by a device such as check valve 54 for activation of the engine poppet valve, or to allow oil to drain out of chamber 53 for retraction of cylinder 36 and deactivation of the valve 12.

The valving control may be any one of several types, such as for example sliding spool, or rotating disk, or rotating shaft. It may be solenoid operated, or air, vacuum, or hydraulic cylinder operated.

Valve 56 is fed oil from a supply gallery or other source (not shown) and directs the oil to load or fill into chamber 53, or to dump or discharge out of chamber 53, on demand. Preferably the oil is the engine lubricating oil and the pump is the engine lubricant circulating pump.

The cylinder 36 and piston 37 are provided with oil ports 57 and 58, respectively, and suitable annular chambers 59 and 60, respectively, properly positioned and dimensioned to provide relatively unimpeded flow of oil into and out of chamber 53.

Figure 2:
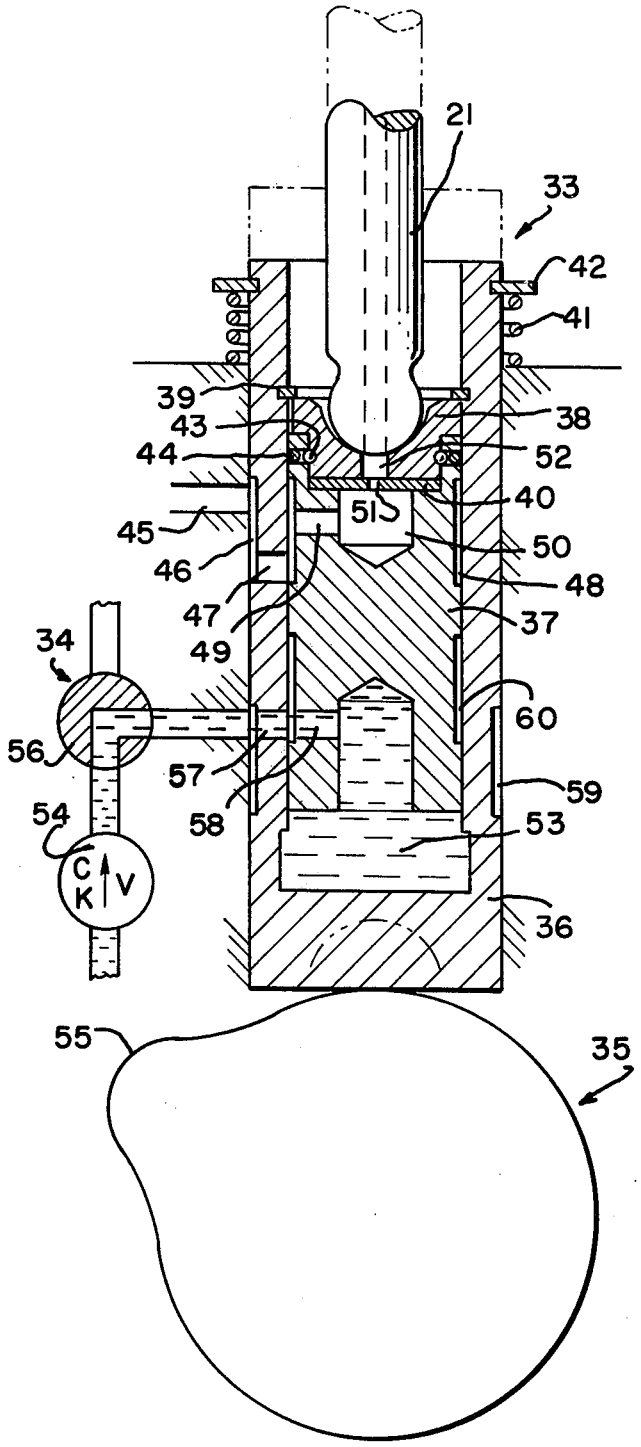
FIG. 2 is a sectional view of the tappet with the tappet control system shown schematically, the positions of the tappet parts shown as they are relatively positioned during reciprocation of the poppet valve shown in FIG. 1.

When valve 56 is in the position shown in FIG. 2, oil is fed through annular chamber 59, port 57, annular chamber 60, and port 58 into chamber 53 to load the chamber with oil and activate the poppet valve 12. The filling may occur over several engine camshaft revolutions. Each instant cam 35 is not pushing the tappet and thus highly pressurizing the oil in chamber 53, oil is forced into chamber 53 from its relatively low pressure source. Spring 41 is not strong enough to seriously interfere with the downward movement of cylinder 36. Check valve 54 blocks oil escape back through the inlet passages. Chamber 53 fills until there is no backlash or play from the cam 35 to valve 12. Thus, tappet 33 in effect becomes a solid length except for negligible effects of compressibility of oil in chamber 53 and passageways back to check valve 54, and a slight loss of oil between mating sliding surfaces. Make-up oil to replace lost oil is pumped into the tappet as required, during the dwell period of the cam. It is desirable that check valve 54 be close to chamber 53 so the compressibility factor is negligible even during occurrence of high presure when the engine valve is opened against the heavy resistance of engine valve spring 16 and the pressure of gasses of combustion.

Figure 3:
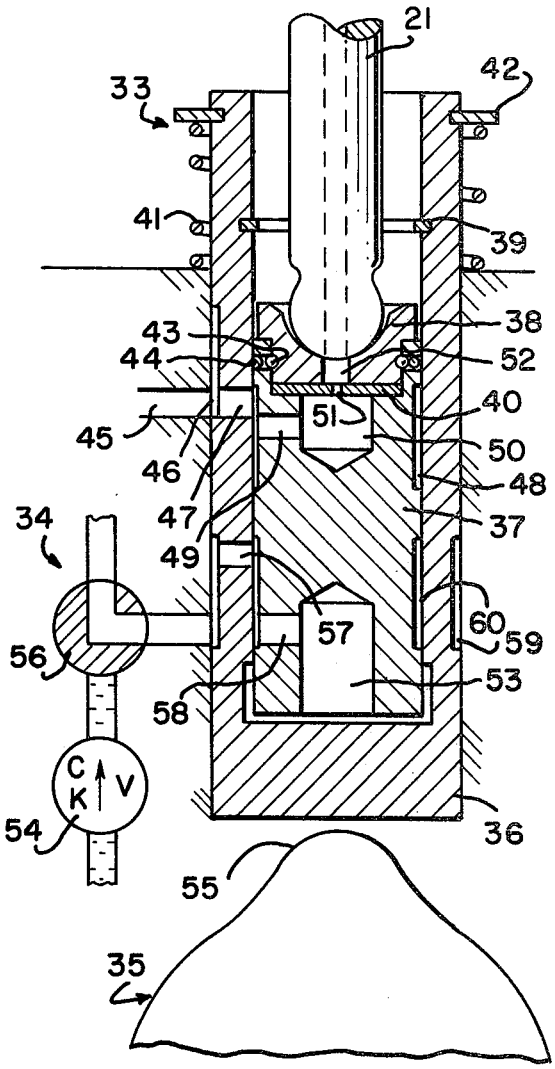
FIG. 3 is a view similar to FIG. 2 but showing the positions of the parts when the tappet, poppet valve operating mechanism, and poppet valve are deactivated.

When valve 56 is in the position shown in FIG. 3, oil in chamber 53 is free to escape and return to the engine crankcase or other collection space. This may occur over several engine camshaft revolutions. Each lift of cam 35 is resisted by poppet valve spring 16 and its forces go back through the rocker arm and push rod to squeeze oil out of chamber 53. Spring 41 will hold cylinder 36 in its raised position, out of operating contact with the cam. Thus, wear, noise, and power consumption are negligible because there is no motion and no friction.

If tappets 33 are used for both the inlet and exhaust engine valves they should not be filled with oil simultaneously, nor emptied simultaneously, to activate and deactivate the tappets. When the chambers 53 are being filled to actuate the engine valves, the exhaust leads, which means oil enters the exhaust valve tappet chamber to operate the engine exhaust valve before oil enters the intake valve tappet chamber to operate the engine intake valve. When the chambers are being unloaded (oil dumped out to deactivate the engine valves), the intake leads, which means oil dumps out of the intake valve tappet chamber to deactivate the engine intake valve before the oil dumps out of exhaust valve tappet chamber. This condition of "exhaust leads on loading, intake leads on dumping" may be accomplished in various ways well known to those skilled in the art.

Failure to practice this "leading" may result in buckled push rods due to valves trying to open against highly compressed exploded charge forces in the engine combustion chamber. Conventional push rods are not designed for such forces, as valves normally open only when these forces are lowered following the expansion of the gasses in the cylinder.

We claim:

1. In an internal combustion engine having a cylinder head and a reciprocally journalled poppet valve, and means for operating said poppet valve: a collapsible tappet, a control valve, a check valve, and a source of hydraulic oil, the control valve being adapted to control the flow of oil from the source of oil to the tappet, the tappet being normally in contact with the cam of the internal combustion engine so as to be reciprocated by said cam, the tappet including a movable member normally in contact with said cam, and means in contact with said means for operating the poppet valve, said tappet adapted to receive oil from said control valve and to flow oil to said control valve, the flow of oil to the tappet through the check valve serving to keep the movable member in contact with the cam, the flow of oil from the tappet to the control valve causing the movable member of the tappet to be moved to a position whereby the poppet valve, means for operating the poppet valve, and the tappet are deactivated.

2. The combination of claim 1 wherein: the movable member of the tappet is an outer member biased by a resilient means which is strong enough to maintain said outer member out of operative contact with the cam when oil is flowed from the outer member, and the means in contact with said means for operating the poppet valve is an inner member inside said movable outer member, the outer member being movable with respect to the inner member.

* * * * *